US011411342B2

(12) United States Patent
Myer et al.

(10) Patent No.: US 11,411,342 B2
(45) Date of Patent: Aug. 9, 2022

(54) CONNECTOR FOR A FLAT FLEXIBLE CABLE

(71) Applicant: TE Connectivity Services GmbH, Schaffhausen (CH)

(72) Inventors: John Mark Myer, Middletown, PA (US); Hurley Chester Moll, Middletown, PA (US); Forrest Irving Kinsey, Jr., Middletown, PA (US); Ryan David Hetrick, Middletown, PA (US)

(73) Assignee: TE Connectivity Solutions GmbH

( * ) Notice: Subject to any disclaimer, the term of this patent is extended or adjusted under 35 U.S.C. 154(b) by 0 days.

(21) Appl. No.: 17/064,026

(22) Filed: Oct. 6, 2020

(65) Prior Publication Data

US 2021/0408712 A1 Dec. 30, 2021

Related U.S. Application Data

(60) Provisional application No. 63/043,387, filed on Jun. 24, 2020.

(51) Int. Cl.
*H01R 13/426* (2006.01)
*H01R 13/187* (2006.01)
(Continued)

(52) U.S. Cl.
CPC ..... *H01R 13/426* (2013.01); *H01R 4/2404* (2013.01); *H01R 12/592* (2013.01);
(Continued)

(58) Field of Classification Search
CPC .. H01R 13/426; H01R 12/592; H01R 13/187; H01R 13/508; H01R 12/59; H01R 12/77;
(Continued)

(56) References Cited

U.S. PATENT DOCUMENTS 3,336,565 A 8/1967 Crimmins
3,989,336 A * 11/1976 Rizzio, Jr ..... H01R 12/62 439/260

(Continued)

FOREIGN PATENT DOCUMENTS

EP 0113406 A1 7/1984
EP 0189234 A1 7/1986
EP 1835569 A1 9/2007

OTHER PUBLICATIONS

International Search Report, Intl App No. PCT/IB2021/055628, dated Sep. 23, 2021, 4 pages.

*Primary Examiner* — Travis S Chambers

(57) ABSTRACT

A connector for a flat flexible cable includes a housing and a spring clip disposed in the housing. The housing has a main body and a cover. The cover is movable with respect to the main body between an open position and a closed position. The spring clip is resiliently deflectable by the cover. The spring clip is in a first state with the cover in the open position in which the spring clip abuts a conductor exposed through an insulation material of the flat flexible cable with a first contact force. The spring clip is in a second state with the cover in the closed position in which the spring clip abuts the conductor with a second contact force greater than the first contact force.

20 Claims, 10 Drawing Sheets

(51) Int. Cl.

| | |
|---|---|
| ***H01R 13/508*** | (2006.01) |
| ***H01R 12/59*** | (2011.01) |
| ***H01R 12/88*** | (2011.01) |
| ***H01R 12/89*** | (2011.01) |
| ***H01R 4/2404*** | (2018.01) |
| ***H01R 12/85*** | (2011.01) |
| ***H01R 13/11*** | (2006.01) |
| *H01R 12/77* | (2011.01) |

(52) U.S. Cl.
CPC ..... *H01R 12/85* (2013.01); *H01R 12/88* (2013.01); *H01R 12/89* (2013.01); *H01R 13/113* (2013.01); *H01R 13/187* (2013.01); *H01R 13/508* (2013.01); *H01R 12/772* (2013.01); *H01R 12/778* (2013.01)

(58) Field of Classification Search
CPC ..... H01R 12/79; H01R 12/88; H01R 12/89; H01R 4/2404; H01R 12/85; H01R 13/113; H01R 12/772; H01R 12/778; H01R 4/50; H01R 13/5025; H01R 12/69; H01R 12/67
See application file for complete search history.

(56) References Cited

U.S. PATENT DOCUMENTS 4,483,578 A 11/1984 Masahiro
4,530,553 A * 7/1985 Aujla ..... H01R 12/82 439/260
4,531,793 A 7/1985 Hochgesang
4,975,076 A * 12/1990 Mosquera ..... H01R 12/772 439/387
5,873,739 A * 2/1999 Roberts ..... H01R 12/774 439/67
6,056,572 A * 5/2000 Matsumoto ..... H01R 12/79 439/260
6,464,532 B1 10/2002 L'Abbate et al.
6,773,288 B2 * 8/2004 Geltsch ..... H01R 12/61 439/325
6,979,224 B2 * 12/2005 Boemmel ..... H01R 12/592 439/492
7,275,955 B2 * 10/2007 Ko ..... H01R 12/592 439/498
7,367,837 B2 * 5/2008 Pabst ..... H01R 12/592 439/460
8,651,885 B2 * 2/2014 Ashibu ..... H01R 12/87 439/328
2002/0081883 A1 * 6/2002 Hotea ..... H01R 12/88 439/260
2003/0157829 A1 * 8/2003 Kunishi ..... H01R 12/88 439/495
2004/0002254 A1 * 1/2004 Tsunematsu ..... H01R 12/79 439/495
2004/0043655 A1 * 3/2004 Godefroy ..... H01R 12/592 439/460
2006/0154508 A1 * 7/2006 Shimoyama ..... H01R 12/88 439/260
2006/0234542 A1 * 10/2006 Ko ..... H01R 12/592 439/495
2007/0111602 A1 * 5/2007 Suzuki ..... H01R 12/88 439/620.26

* cited by examiner

CONNECTOR FOR A FLAT FLEXIBLE CABLE

CROSS-REFERENCE TO RELATED APPLICATION

This application claims priority under 35 U.S.C. § 119 to U.S. Provisional Patent Application No. 63/043,387, filed on Jun. 24, 2020.

FIELD OF THE INVENTION

The present invention relates to a connector and, more particularly, to a connector for a flat flexible cable.

BACKGROUND

As understood by those skilled in the art, flat flexible cables (FFCs) or flat flexible circuits are electrical components consisting of at least one conductor (e.g., a metallic foil conductor) embedded within a thin, flexible strip of insulation. Flat flexible cables are gaining popularity across many industries due to advantages offered over their traditional "round wire" counter parts. Specifically, in addition to having a lower profile and lighter weight, FFCs enable the implementation of large circuit pathways with significantly greater ease compared to round wire-based architectures. As a result, FFCs are being considered for many complex and/or high-volume applications, including wiring harnesses, such as those used in automotive manufacturing.

The implementation or integration of FFCs into existing wiring environments is not without significant challenges. In an automotive application, by way of example only, an FFC-based wiring harness would be required to mate with perhaps hundreds of existing components, including sub-harnesses and various electronic devices (e.g., lights, sensors, etc.), each having established, and in some cases standardized, connector or interface types. Accordingly, a critical obstacle preventing the implementation of FFCs into these applications includes the need to develop quick, robust, and low resistance termination techniques which enable an FFC to be connectorized for mating with these existing connections.

A typical FFC may be realized by applying insulation material to either side of a pre-patterned thin foil conductor, and bonding the sides together via an adhesive to enclose the conductor therein. Current FFC terminals include piercing-style crimp terminals, wherein sharpened tines of a terminal are used to pierce the insulation and adhesive material of the FFC in order to attempt to establish a secure electrical connection with the embedded conductor. In harsh environmental conditions, however, such a connection suffers from plastic creep and stress relaxation of the metal, leading to inconsistent electrical connectivity between the conductor and the terminal and mechanical unreliability over time. Terminals can alternatively be soldered to the FFC, but soldering increases the difficulty in assembly and requires inspection.

SUMMARY

A connector for a flat flexible cable includes a housing and a spring clip disposed in the housing. The housing has a main body and a cover. The cover is movable with respect to the main body between an open position and a closed position. The spring clip is resiliently deflectable by the cover. The spring clip is in a first state with the cover in the open position in which the spring clip abuts a conductor exposed through an insulation material of the flat flexible cable with a first contact force. The spring clip is in a second state with the cover in the closed position in which the spring clip abuts the conductor with a second contact force greater than the first contact force.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
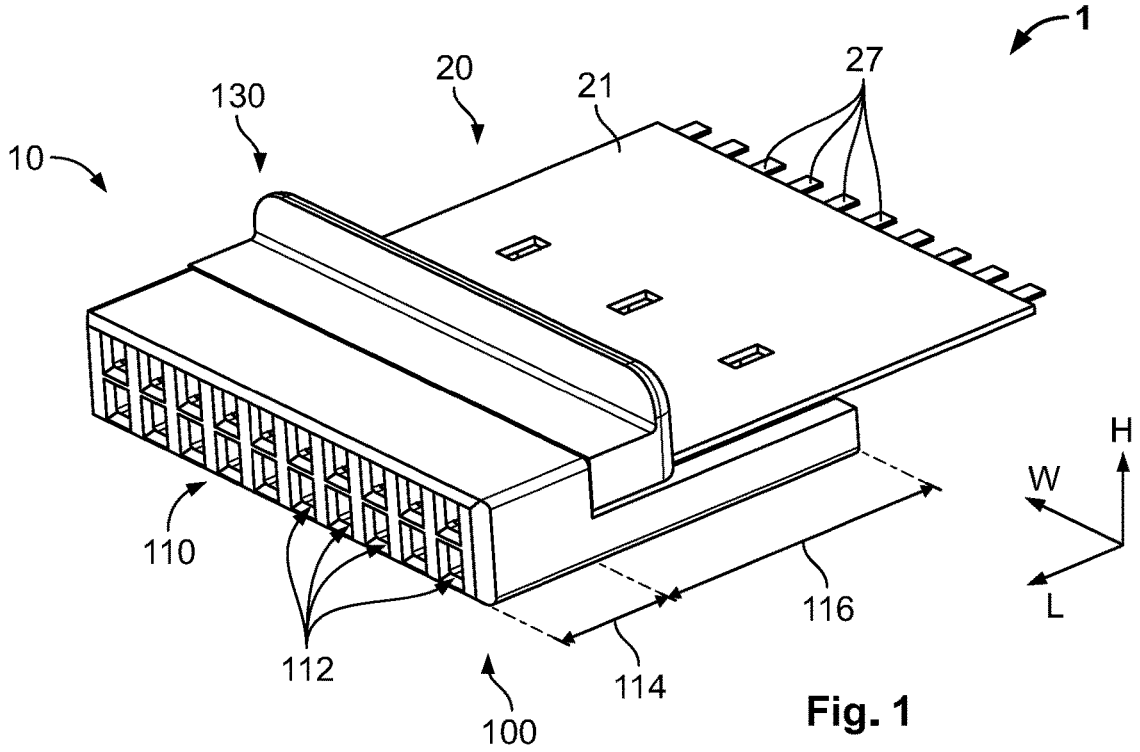
FIG. 1 is a perspective view of a connector assembly according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

Figure 3:
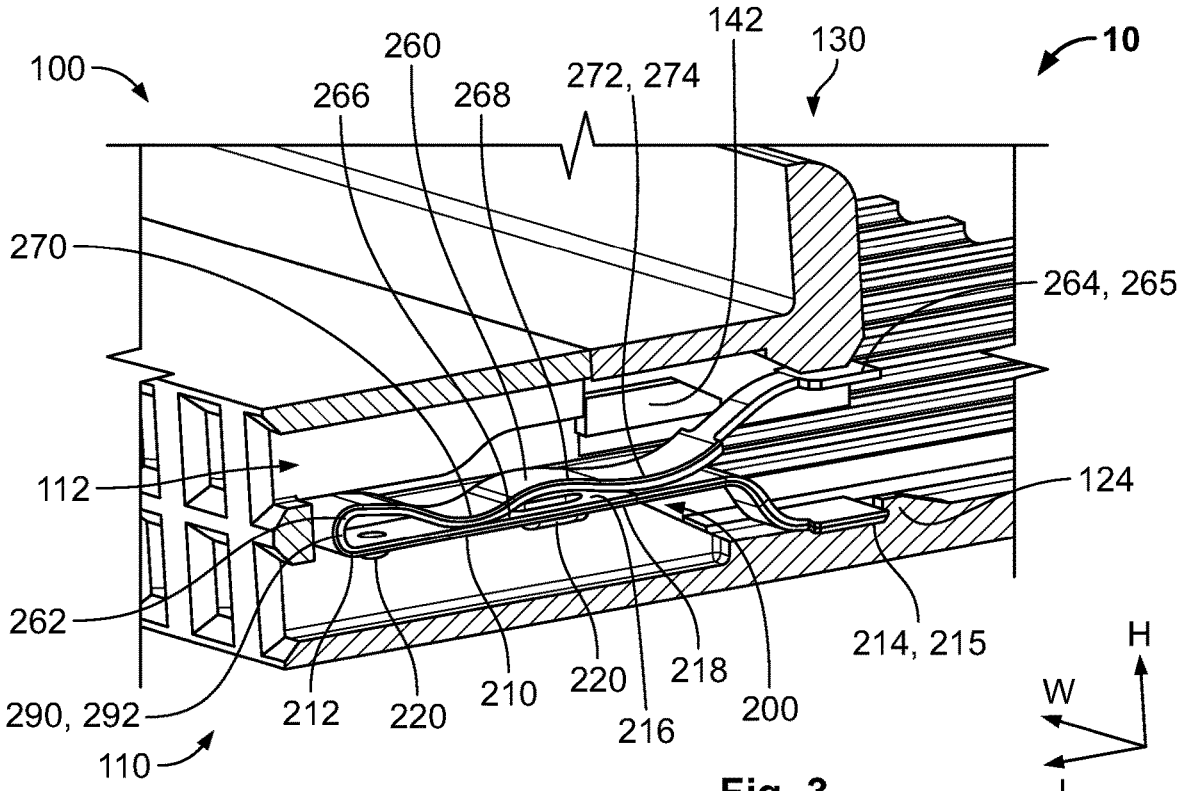
FIG. 3 is a sectional perspective view of a connector of the connector assembly of FIG. 1.

A connector assembly 1 according to an embodiment is shown in FIG. 1. The connector assembly 1 comprises a connector 10 and a flat flexible cable (FFC) 20 connected to the connector 10. The connector 10, as shown in FIG. 3, includes a housing 100 and a spring clip 200 disposed in the housing 100.

The housing 100, as shown in FIGS. 1-5, includes a main body 110 and a cover 130 that is movable with respect to the main body 110 and attachable to the main body 110.

Figure 2:
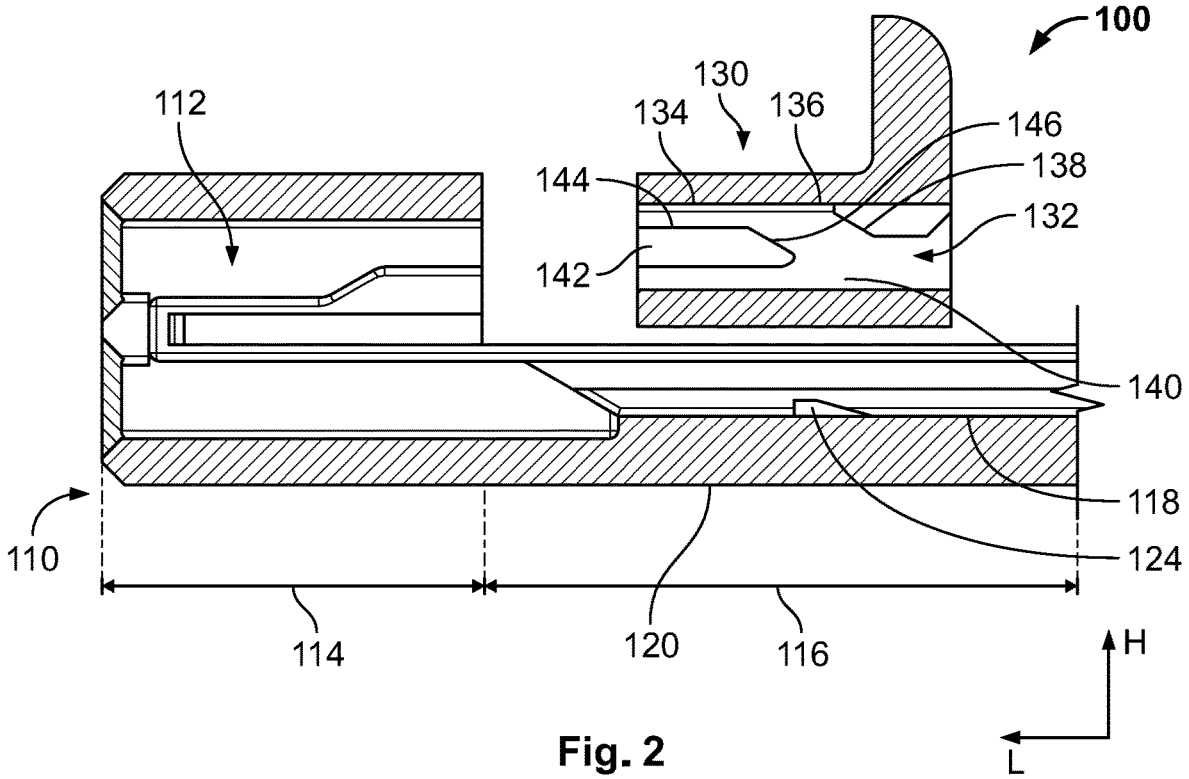
FIG. 2 is a sectional side view of a housing of the connector assembly of FIG. 1.

The main body 110, as shown in FIGS. 1 and 2, has a plurality of clip receiving passageways 112 extending through the main body 110 along a longitudinal direction L. The main body 110 has a closed section 114 in which the main body 110 encloses the clip receiving passageways 112 in a height direction H perpendicular to the longitudinal direction L and a width direction W perpendicular to both the height direction H and the longitudinal direction L. The main body 110 has an open section 116 in which the clip receiving passageways 112 are open on a top in the height direction H. In the embodiment shown in FIGS. 1-5, the open section 116 is also open on at least a portion of each of a pair of opposite sides in the width direction W.

In the open section 116, as shown in FIG. 2, the main body 110 has an interior surface 118 and an exterior surface 120 opposite the interior surface 118 in the height direction H. The main body 110 has a plurality of latches 124 positioned on the interior surface 118 in the open section 116 and extending in the height direction H into the clip receiving passageways 112. Each of the latches 124 is positioned to extend into one of the clip receiving passageways 112. Only one of the latches 124 is shown in FIG. 2 corresponding to one of the clip receiving passageways 112, but the main body 110 includes one latch 124 corresponding with each of the clip receiving passageways 112 shown in FIG. 1.

The main body 110 is formed of an insulative material. In an embodiment, the main body 110 is monolithically formed in a single piece with the closed section 114 and the open section 116. In other embodiments, the main body 110 can be formed in multiple pieces and assembled together to form the main body 110 as shown in FIGS. 1 and 2 and described above.

The cover 130, as shown in FIG. 2, has a plurality of beam receiving passageways 132 extending through the cover 130 in the longitudinal direction L. Only one of the beam receiving passageways 132 is shown in FIG. 2, corresponding to one of the clip receiving passageways 112, but the cover 130 includes one beam receiving passageway 132 corresponding with each of the clip receiving passageways 112 shown in FIG. 1.

At each of the beam receiving passageways 132, as shown in FIG. 2, the cover 130 has an upper surface 134 enclosing the beam receiving passageway 132 in the height direction H. The upper surface 134 has an upper flat section 136 and an upper sloped section 138 extending from the upper flat section 136. The upper surface 134 is flat and extends parallel to a plane defined by the width direction W and the longitudinal direction L in the upper flat section 136; the upper flat section 136 is parallel to the interior surface 118 of the open section 116 of the main body 110. In the upper sloped section 138, the upper surface 134 extends at an oblique angle with respect to the upper flat section 136 and toward the interior surface 118 in the height direction H.

As shown in FIG. 2, at each of the beam receiving passageways 132, the cover 130 has a pair of side surfaces 140 extending from the upper surface 134 along the height direction H. The pair of side surfaces 140 are positioned opposite one another in the width direction W to enclose the beam receiving passageway 132 in the width direction W. Only one of the side surfaces 140 is shown in the sectional view of FIG. 2; the other side surface is mirror symmetrical to the side surface 140 shown in FIG. 2.

As shown in FIG. 2, each of the side surfaces 140 has a ramp protrusion 142 extending into the beam receiving passageway 132 in the width direction W. The ramp protrusion 142 has a ramp flat section 144 and a ramp sloped section 146 extending from the ramp flat section 144. The ramp flat section 144 is parallel to the upper flat section 136. The ramp sloped section 146 extends at an oblique angle with respect to the ramp flat section 144 and in a same direction as the upper sloped section 138. In the shown embodiment, the ramp sloped section 146 extends at a same angle from the ramp flat section 144 as the upper sloped section 138 extends from the upper flat section 136; the ramp sloped section 146 and the upper sloped section 138 are parallel to one another. The ramp flat section 144 is separated from the upper flat section 136 along the height direction H and the ramp sloped section 146 is separated from the upper sloped section 138 along the height direction H and the longitudinal direction L.

The cover 130 is formed of an insulative material. In an embodiment, the cover 130 is monolithically formed in a single piece with the upper surface 134 and the side surfaces 140. In other embodiments, the cover 130 can be formed in multiple pieces and assembled together to form the cover 130 as shown in FIGS. 1 and 2 and described above.

The spring clip 200, as shown in FIG. 3, has a first beam 210 and a second beam 260 connected to the first beam 210 at a connection section 290.

The first beam 210, as shown in FIG. 3, has a first connected end 212 connected to the connection section 290 and extends away from the first connected end 212 along the longitudinal direction L to a first free end 214. At the first free end 215, the first beam 210 has a first tab 215 with a width greater than a width of an immediately adjacent portion of the first beam 210 in the width direction W. The first beam 210 has a first interior surface 216 facing the second beam 260 and a first exterior surface 218 facing away from the second beam 260 in the height direction H.

As shown in FIG. 3, the first beam 210 has a plurality of support protrusions 220 positioned between the first connected end 212 and the first free end 214 along the longitudinal direction L and extending away from the first exterior surface 218 in the height direction H. In the shown embodiment, the plurality of support protrusions 220 are two support protrusions 220 spaced apart from each other along the longitudinal direction L. In other embodiments, the support protrusions 220 may include only one support protrusion 220 or more than two support protrusions 220 spaced apart from one another along the longitudinal direction L. In an embodiment, the support protrusions 220 may be formed by stamping or bending the first beam 210.

The second beam 260, as shown in FIG. 3, has a second connected end 262 connected to the connection section 290 and extends away from the second connected end 262 along the longitudinal direction L to a second free end 264. At the second free end 264, the second beam 260 has a second tab 265 with a width greater than a width of an immediately adjacent portion of the second beam 260 in the width direction W. The second beam 260 has a second interior surface 266 facing the first beam 210 and a second exterior surface 268 facing away from the first beam 210 in the height direction H.

As shown in FIG. 3, the second beam 260 has a first contact bend 270 and a second contact portion 272 between the second connected end 262 and the second free end 264. The first contact bend 270 extends toward the first beam 210. In the shown embodiment, the second contact portion 272 is a second contact bend 274 similar to the first contact bend 270 and extending toward the first beam 210. The first contact bend 270 is positioned proximal to the second connected end 262 and the second contact portion 272 is positioned proximal to the second free end 264. The second contact portion 272 is positioned further from the connection section 290 than the first contact bend 270.

The connection section 290, in the embodiment shown in FIG. 3, is a curved portion 292 connecting the first beam 210 and the second beam 260. The second beam 260 is resiliently deflectable toward the first beam 210 about the curved portion 292.

The spring clip 200 is formed of an electrically conductive material. The spring clip 200 may be formed of a single conductive material, such as copper or aluminum, or may be an alloy or include multiple layers of electrically conductive materials. In an embodiment, the spring clip 200 has a coating covering the electrically conductive material, such as a tin coating. In the shown embodiment, the spring clip 200 is monolithically formed in a single piece with the first beam 210, the second beam 260, and the connection section 290. In other embodiments, the spring clip 200 may be formed in a plurality of pieces and assembled to form the spring clip 200 with the elements described above and shown in FIG. 3.

Figure 4:
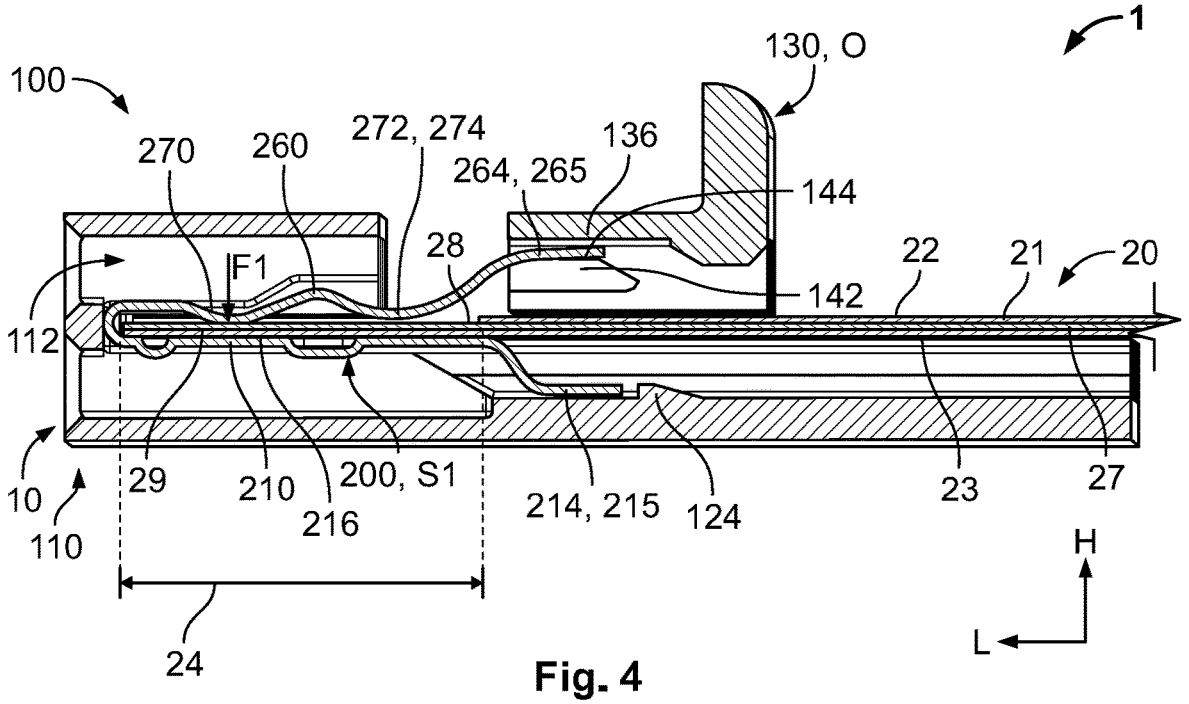
FIG. 4 is a sectional side view of the connector assembly of FIG. 1 with a cover in an open position.

To assemble the connector 10, as shown in FIGS. 3 and 4, the spring clips 200 are each inserted into one of the clip receiving passageways 112 of the main body 110. The spring clip 200 is inserted from the open section 116 into the clip receiving passageway 112 of the closed section 114 along the longitudinal direction L. The spring clip 200 is positioned with the first free end 214 of the first beam 210 adjacent to the latch 124, which holds the spring clip 200 in position in the clip receiving passageway 112 along the longitudinal direction L.

As shown in FIG. 4, in an open position O of the cover 130, the cover 130 is separated from the main body 110 at least along the longitudinal direction L and engages the second beam 260. The second tab 265 at the second free end 264 of the second beam 260 is positioned between the ramp flat section 144 and the upper flat section 136 in the height direction H, holding the spring clip 200 in a first state S1 in the open position O of the cover 130. In the first state S1, the second beam 260 is resiliently deflected away from the first beam 210.

The FFC 20 is inserted into the connector 10 with the cover 130 in the open position O and the spring clip 200 in the first state S1, as shown in FIG. 4. The FFC 20, as shown in FIGS. 1 and 4, includes an insulation material 21 and a plurality of flat conductors 27 embedded in the insulation material 21. In an embodiment, the flat conductors 27 are each a metallic foil, such as a copper foil, by way of example only, patterned in any desirable configuration. The insulation material 21, such as a polymer insulation material, may be applied to either or both sides of the flat conductors 27 via an adhesive material or extruded directly over the flat conductors 27. The flat conductors 27 may also be referred to as conductors 27 herein.

The insulation material 21, as shown in FIG. 4, has an upper side 22 and a lower side 23 opposite the upper side 22 in the height direction H. The conductors 27 are embedded in the insulation material 21 between the upper side 22 and the lower side 23. The FFC 20, in the embodiment shown in FIG. 4, has a stripped section 24 in which the upper side 22 of the insulation material 21 is removed to expose a first side 28 of the conductors 27. A second side 29 of the conductors 27 opposite the first side 28 in the height direction H is entirely covered with the lower side 23 of the insulation material 21 in the stripped section 24 in the embodiment shown in FIG. 4.

As shown in FIG. 4, the stripped section 24 is inserted into the connector 10 between the first beam 210 and the second beam 260 in the height direction H with the cover 130 in the open position O and the spring clip 200 in the first state S1. Each of the conductors 27 exposed in the stripped section 24 is positioned in one of the clip receiving passageways 112 and corresponds to one of the spring clips 200. The spring clip 200 in the first state S1, with the second beam 260 deflected away from the first beam 210, eases insertion of the FFC 20.

In the fully inserted position of the FFC 20 with the spring clip 200 in the first state S1, as shown in FIG. 4, the first interior surface 216 of the first beam 210 abuts the lower side 23 of the insulation material 21 and is separated from the second side 29 of the conductor 27 by the insulation material 21. The first contact bend 270 of the second beam 260 abuts the first side 28 of the conductor 27 exposed through the insulation material 21 in the stripped section 24 with a first contact force F1 in the first state S1. The spring clip 200 is electrically connected with the conductor 27 through the first contact bend 270 in the first state S1. In the first state S1, the second contact portion 272 is separated from the conductor 27.

Figure 5:
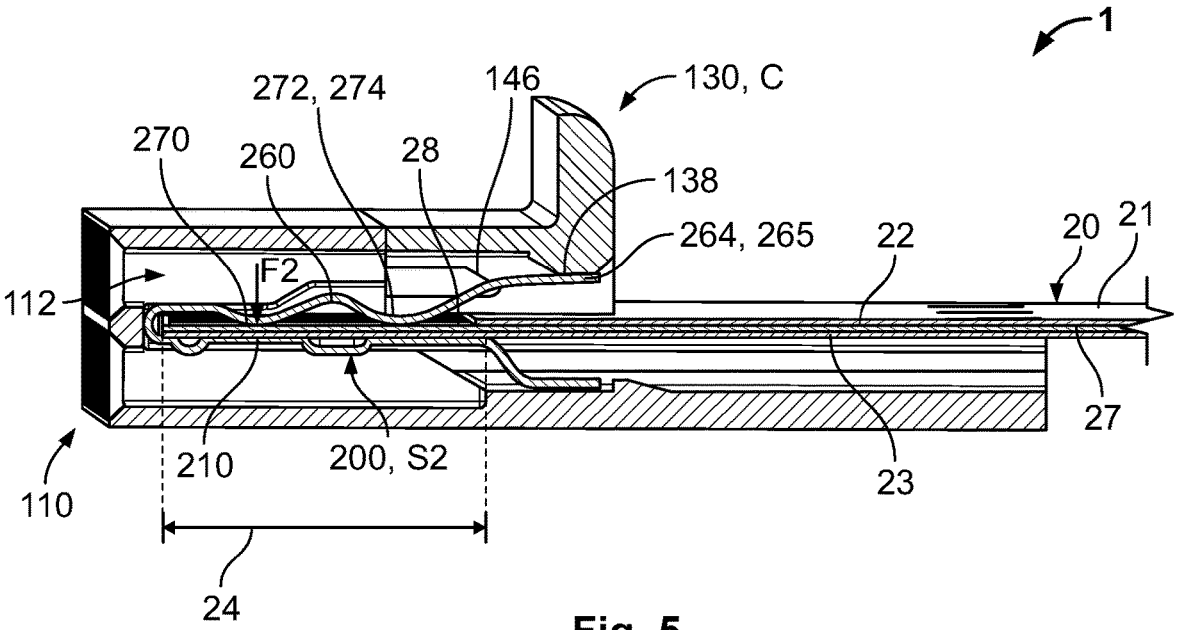
FIG. 5 is a sectional perspective view of the connector assembly of FIG. 1 with the cover in a closed position.

From the open position O shown in FIG. 4, the cover 130 is moved toward the main body 110 along the longitudinal direction L into a closed position C shown in FIG. 5. As the cover 130 moves toward the main body 110, the second free end 264 of the second beam 260 initially slides between the upper flat section 136 and the ramp flat section 144, maintaining the second beam 260 in the first state S1 shown in FIG. 4 deflected away from the second beam 260. The second free end 264 moves along the upper flat section 136 and to the upper sloped section 138 with movement of the cover 130 in the longitudinal direction L. When the second free end 264 reaches the upper sloped section 138, the second free end 264 slides between the upper sloped section 138 and the ramp sloped section 146 as the cover 130 continues to move toward the closed position C. The second beam 260 is deflected progressively toward the first beam 210 in the height direction H as the second free end 264 abuts and slides along the upper sloped section 138.

When the cover 130 reaches the closed position C shown in FIG. 5, the second beam 260 is held in a second state S2 of the spring clip 200 in which the second beam 260 is maximally deflected by the cover 130 toward the first beam 210. In the second state S2, the first contact bend 270 abuts the first side 28 of the conductor 27 with a second contact force F2 greater than the first contact force F1 due to the deflection of the second beam 260 toward the first beam 210. The second contact portion 272, the second contact bend 274 in the shown embodiment, also abuts the first side 28 of the conductor 27 exposed through the insulation material 21 in the stripped section 24 in the second state S2. The first contact bend 270 and the second contact portion 272 electrically connect the spring clip 200 with the conductor 27 of the FFC 20 at multiple contact points in the second state S2.

In the closed position C shown in FIG. 5, the cover 130 can be attached to the main body 110 to hold the spring clip 200 in the second state S2 electrically connected to the conductor 27 of the FFC 20. In an embodiment, the cover 130 can be attached to the main body 110 in a releasable manner, for example, by a resilient latch. In other embodiments, the cover 130 can be secured to the main body 110 in the closed position C in a non-releasable manner, for example, by ultrasonic welding.

The movement of the cover 130 with respect to the main body 110 between the open position O and the closed position C, correspondingly moving the spring clip 200 between the first state S1 and the second state S2, allows the FFC 20 to be easily inserted into the connector 10 in the open position O while also allowing for a robust electrical connection between the spring clip 200 and the FFC 20 in the closed position C. The high second contact force F2 in the closed position C allows for a mechanical and electrical connection with low resistance values between the FFC 20 and the spring clip 200 while the multiple contact points, at the first beam 210, the first contact bend 270, and the second contact portion 272, prevent rotation and improve vibration resistance of the connection.

When assembled in the closed position C as shown in FIG. 5, the connector assembly 1 can be mated with a mating element that electrically connects with the FFC 20 through the spring clip 200. In the shown embodiment, the spring clip 200 with the curved portion 292 as the connection section 290 is matable with a tuning fork inserted into the housing 100. In other embodiments, with other connection sections 290, the spring clip 200 can be matable with a number of other electrical terminals, such as a pin.

A connector assembly 1 according to another embodiment is shown in FIGS. 6-12. Like reference numbers indicate like elements and primarily the differences with respect to the connector assembly 1 shown in FIGS. 1-5 will be described herein.

Figure 6:
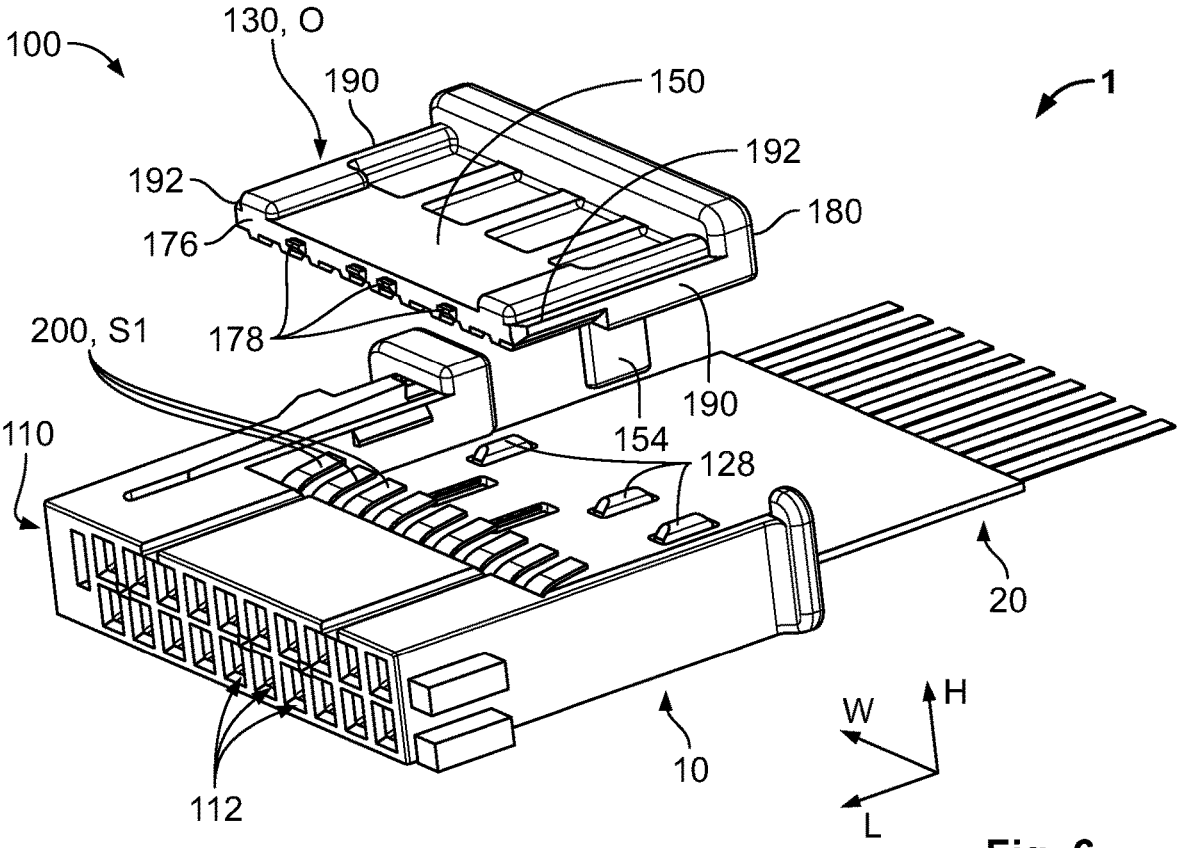
FIG. 6 is a perspective view of a connector assembly according to another embodiment with a cover in an open position.

As shown in FIG. 6, the housing 100 includes the main body 110 and the cover 130 movable with respect to the main body 110.

Figure 7:
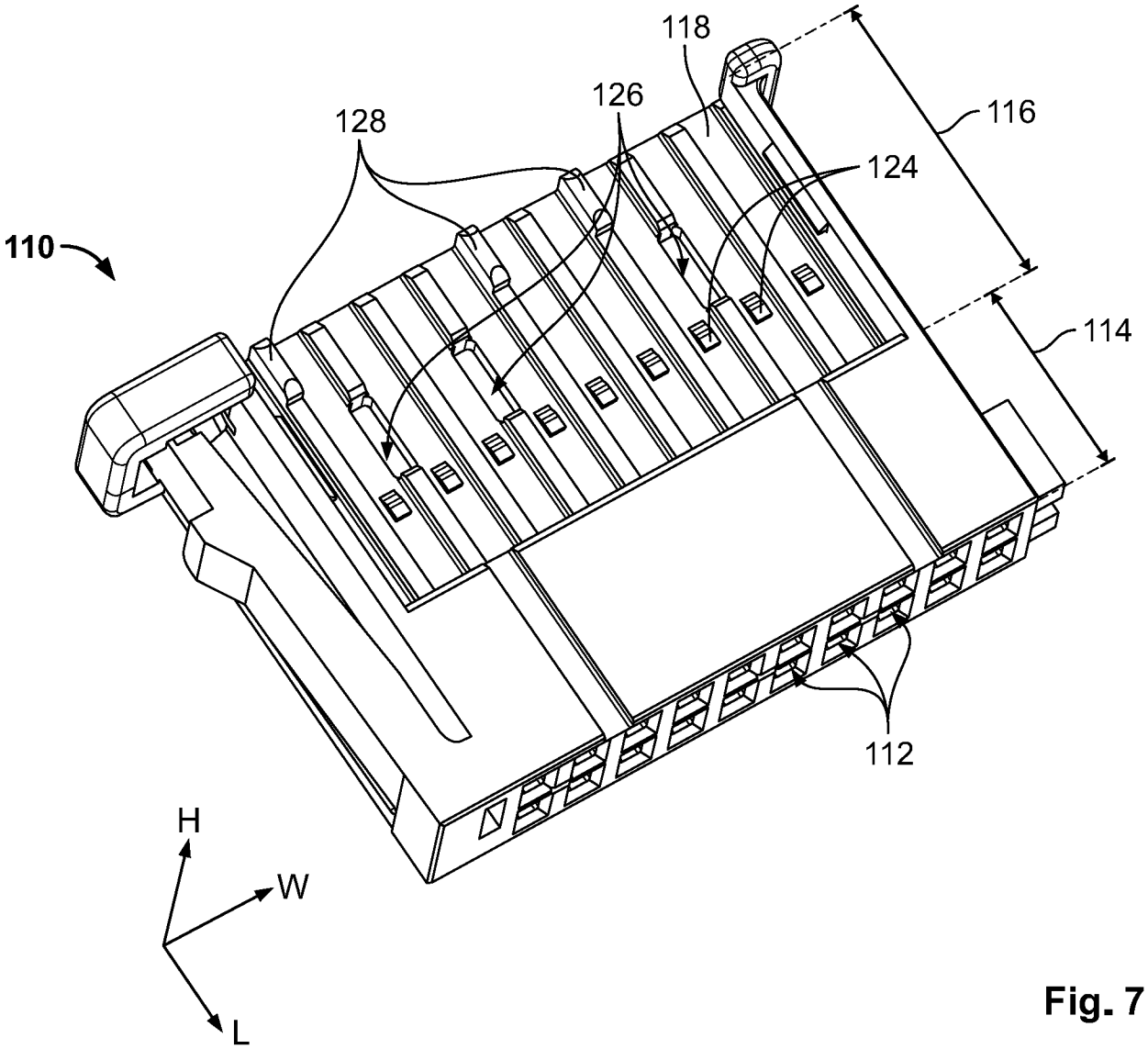
FIG. 7 is a perspective view of a main body of the connector assembly of FIG. 6.

The main body 110, as shown in FIGS. 6 and 7, has a plurality of slots 126 extending through the open section 116 in the height direction H and a plurality of posts 128 positioned on the interior surface 118 in the open section 116 and extending away from the interior surface 118 in the height direction H. In the shown embodiment, the posts 128 are monolithically formed with the main body 110 in a single piece. In the shown embodiment, the main body 110 has three slots 126 and three posts 128, however, the number and arrangement of the slots 126 and the posts 128 in the open section 116 can vary from the shown embodiment.

Figure 11:
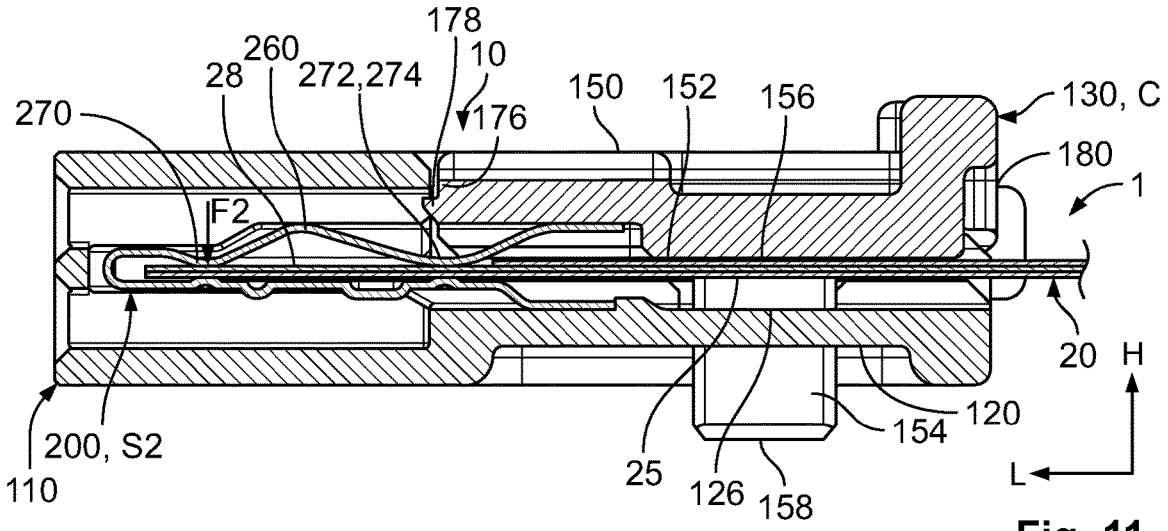
FIG. 11 is a sectional side view of the connector assembly of FIG. 6 in a closed position.

The cover 130, as shown in FIGS. 6 and 11, has an exterior surface 150 and an interior surface 152 opposite the exterior surface 150 in the height direction H. The cover 130 has a plurality of pegs 154 extending from the interior surface 152 in the height direction H. Each of the pegs 154 is attached to the cover 130 at a connected end 156 and extends away from the cover 130 to an attachment end 158 in the height direction H. Only one of the plurality of pegs 154 is visible in FIGS. 6 and 11, however, the pegs 154 are distributed along the interior surface 152 in an arrangement corresponding in number and position to the slots 126 in the main body 110. In various embodiments, the number and position of the pegs 154 extending from the cover 130 can vary provided they correspond to the slots 126 in the main body 110.

As shown in FIGS. 6 and 11, the cover 130 has a front surface 176, a rear surface 180, and a pair of side surfaces 190 extending in the height direction H between the exterior surface 150 and the interior surface 152. The front surface 176 has a plurality of front catches 178 protruding from the front surface 176 in the longitudinal direction L. The side surfaces 190 each have a side catch 192 extending from the side surface 190 in the width direction W. In the shown embodiment, the front surface 176 has four front catches 178 and each side surface 190 has one side catch 192. In other embodiments, the number and arrangement of the front catches 178 and the side catches 192 can vary provided they are capable of serving the functions described below.

The cover 130 is formed from an insulative material. In the embodiment shown in FIGS. 6 and 11, the cover 130 is monolithically formed in a single piece. In other embodiments, the cover 130 may be formed in multiple pieces and assembled together to form the cover 130 as shown in FIGS. 6 and 11.

Figure 8:
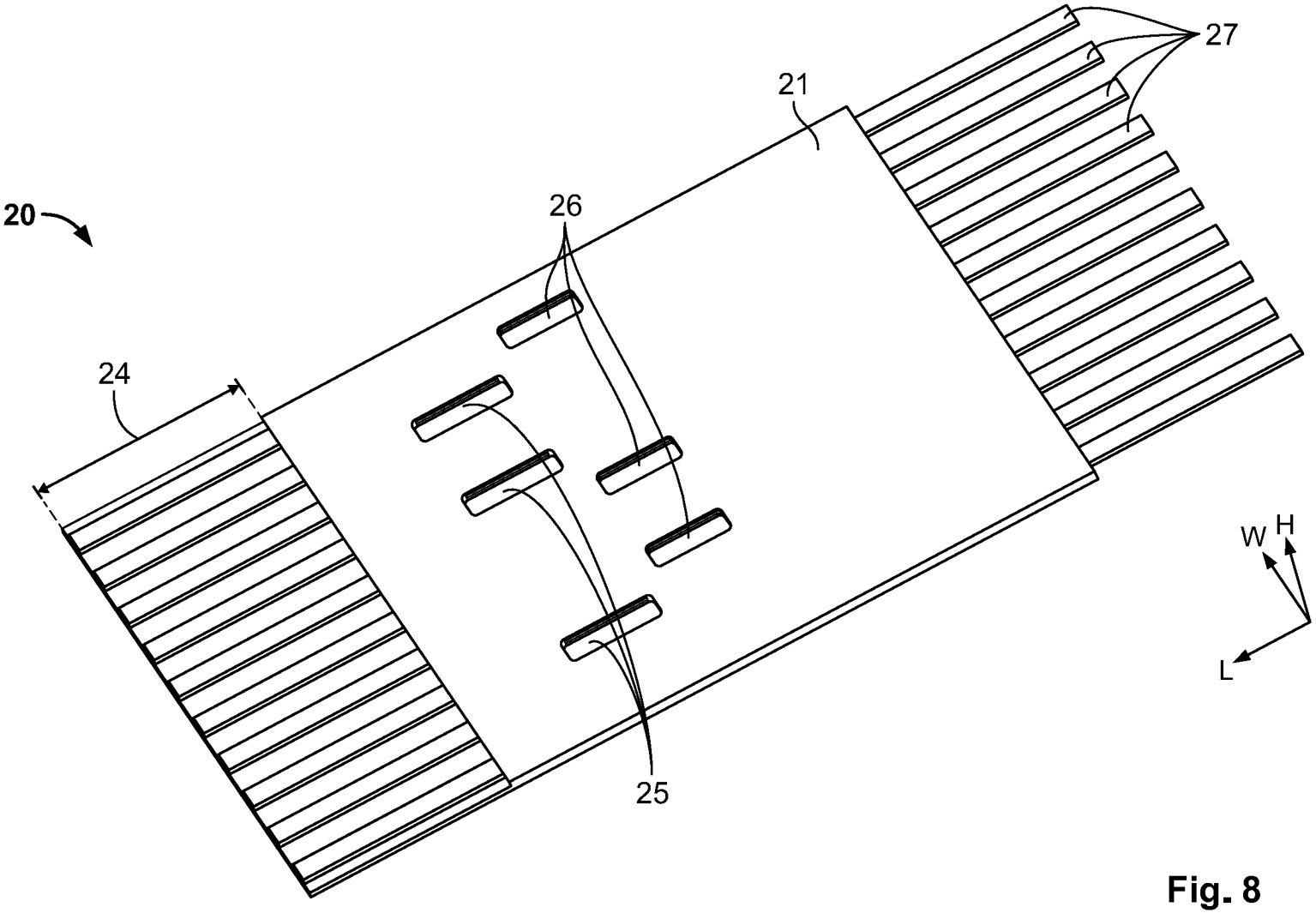
FIG. 8 is a perspective view of a flat flexible cable of the connector assembly of FIG. 6.
Figure 9:
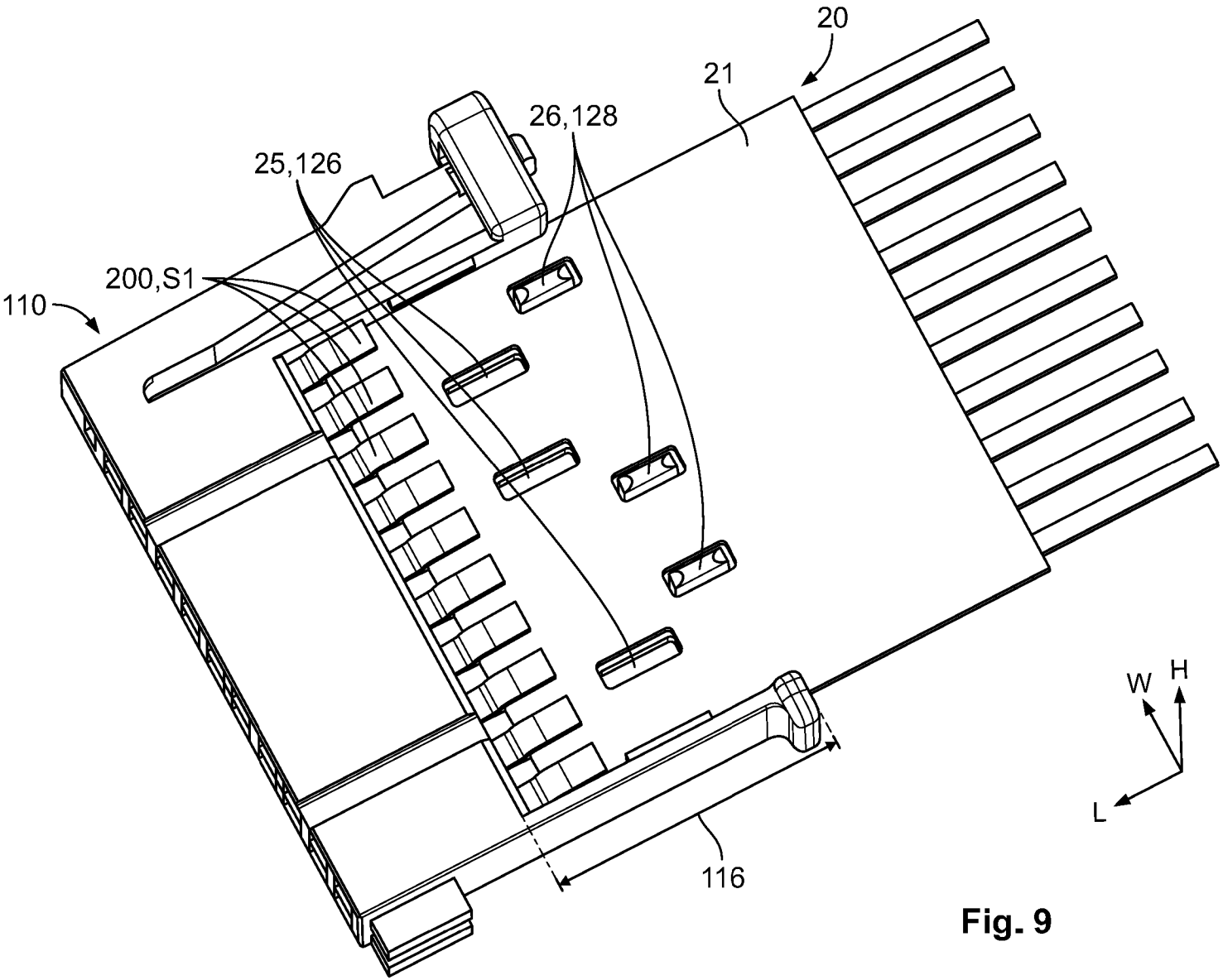
FIG. 9 is a perspective view of the flat flexible cable inserted into the main body of the connector assembly of FIG. 6.
Figure 10:
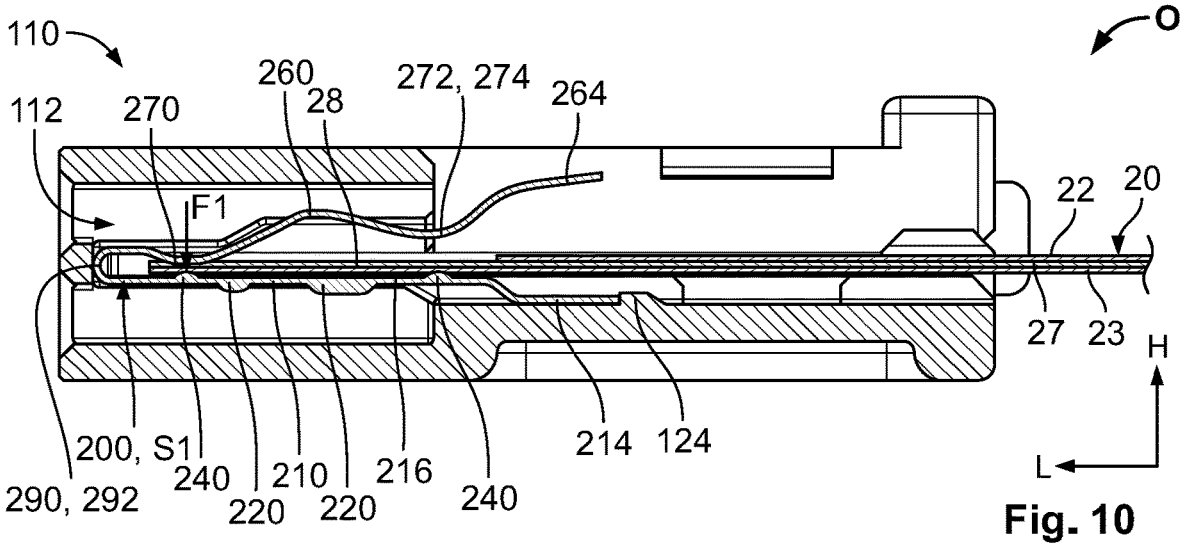
FIG. 10 is a sectional side view of the connector assembly of FIG. 6 in the open position.

In the connector assembly 1 according to the embodiment of FIGS. 6-12, the connector 10, as shown in FIGS. 6, 9, and 10, has the spring clip 200. The spring clip 200, as shown in FIG. 10, has a plurality of contact protrusions 240 extending from the first interior surface 216 of the first beam 210 toward the second beam 260 in the height direction H. The contact protrusions 240 are spaced apart from one another along the longitudinal direction L. In the shown embodiment, one of the contact protrusions 240 is aligned with the first contact bend 270 along the longitudinal direction L and the other of the contact protrusions 240 is aligned with the second contact portion 272 along the longitudinal direction L. The contact protrusions 240 may be formed by stamping or bending the first beam 210. In other embodiments, in lieu of the contact protrusions 240, the first beam 210 may have a plurality of serrations or a plurality of piercing elements.

In the connector assembly 1 according to the embodiment of FIGS. 6-12, the FFC 20, as shown in FIG. 8, has a plurality of peg openings 25 and a plurality of post openings 26 extending through the insulation material 21 in the height direction H. The peg openings 25 and post openings 26 extend through the insulation material 21 outside of the stripped section 24 and are each positioned between a pair of conductors 27 in the width direction W. The peg openings 25 are aligned with one another along the width direction W and the post openings 26 are aligned with one another along the width direction W. The peg openings 25 are positioned closer to the stripped section 24 than the post openings 26 along the longitudinal direction L. In the shown embodiment, the FFC 20 has three peg openings 25 and three post openings 26. In other embodiments, the number and arrangement of the peg openings 25 can vary provided they correspond to the pegs 154 of the cover 130 and the number and arrangement of the post openings 26 can vary provided they correspond to the posts 128 of the main body 110.

As shown in FIGS. 9 and 10, the spring clips 200 are inserted into the clip receiving passageways 112 of the main body 110 as described in the embodiment of FIGS. 1-5 and are held along the longitudinal direction L by engagement with the latches 124. The spring clips 220 are each in a non-deflected state in the first state S1 of the spring clips 200 shown in FIGS. 9 and 10. In the first state S1, the second free end 264 of the second beam 260 is positioned in the open section 116 and exposed to an exterior of the main body 110.

The FFC 20, as shown in FIGS. 6, 9, and 10, is inserted into the main body 110 with the spring clips 200 in the first state S1. The FFC 20 is inserted until the peg openings 25 are aligned with the slots 126 and the posts 128 extend through the post openings 26. The posts 128 extend through the post openings 26 to provide strain relief in case the FFC 20 is pulled or otherwise moved and also position the FFC 20 within the main body 110.

As shown in FIG. 10, with the FFC 20 fully inserted into the main body 110, the contact protrusions 240 abut the lower side 23 of the insulation material 21. The first contact bend 270 of the second beam 260 abuts the first side 28 of the conductor 27 exposed through the insulation material 21 in the stripped section 24 with a first contact force F1 in the first state S1. The spring clip 200 is electrically connected with the conductor 27 through the first contact bend 270 in the first state S1. In the first state S1, the second contact portion 272 is separated from the conductor 27. FIGS. 6 and 10, with the cover 130 removed from the main body 110 and the spring clips 200 in the first state S1, corresponds to the open position O of the shown embodiment.

From the open position O shown in FIGS. 6 and 10, the cover 130 is positioned on the main body 110. As shown in FIG. 11, the pegs 154 are each inserted through one of the peg openings 25 and one of the slots 126 aligned with each other. In an embodiment, the pegs 154, peg openings 25, and slots 126 are each arranged in a non-symmetrical manner to ensure that the cover 130 can only be moved toward the closed position C in a particular orientation. The interior surface 152 contacts the second free end 264 and deflects the second beam 260 toward the first beam 210 as the cover 130 is moved toward the main body 110 in the height direction H.

The cover 130 is moved toward the main body 110 and the pegs 154 are inserted until the interior surface 152 abuts against the FFC 20 in a closed position C of the cover 130 shown in FIG. 11. In the closed position C, the second beam 260 is held in a second state S2 of the spring clip 200 in which the second beam 260 is maximally deflected by the cover 130 toward the first beam 210. In the second state S2, the first contact bend 270 abuts the first side 28 of the conductor 27 with a second contact force F2 greater than the first contact force F1 due to the deflection of the second beam 260 toward the first beam 210. The second contact portion 272, the second contact bend 274 in the shown embodiment, also abuts the first side 28 of the conductor 27 exposed through the insulation material 21 in the stripped section 24 in the second state S2. The first contact bend 270 and the second contact portion 272 electrically connect the spring clip 200 with the conductor 27 of the FFC 20 at multiple contact points in the second state S2. In other embodiments, the FFC 20 may have windows through which the conductors 27 are exposed and the contact protrusions 240 and/or the first contact bend 170 and the second contact portion 272 may extend through the windows to contact the conductors 27.

Figure 12:
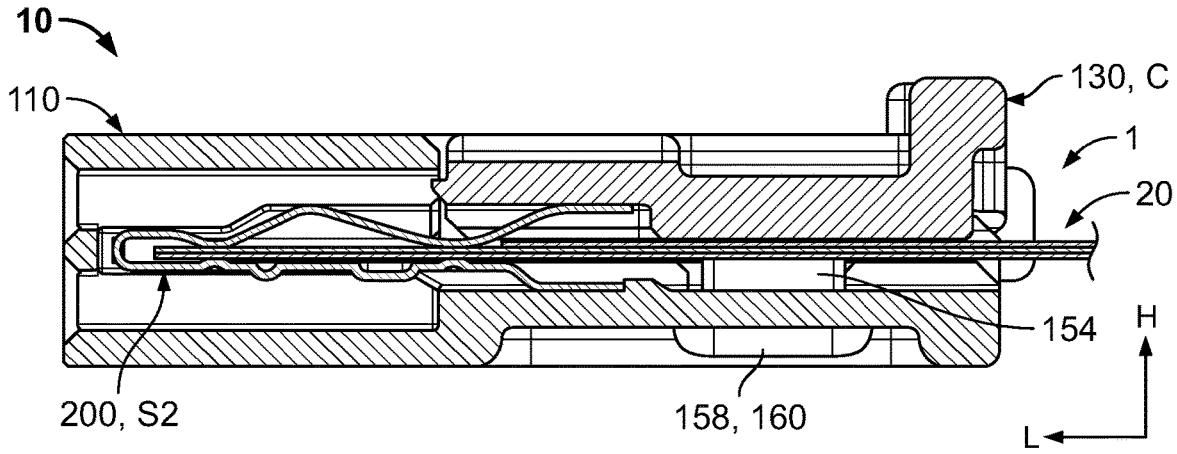
FIG. 12 is a sectional side view of the connector assembly of FIG. 6 in the closed position with an attachment end of a post formed as a staked head.

In the closed position C, as shown in FIG. 11, the peg 154 extends through the peg opening 25 and the slot 126 and the attachment end 158 extends beyond an exterior surface 120 of the main body 110. The cover 130 is initially latched in the closed position C by engagement of the front catches 176 and the side catches 192 with the main body 110. As shown in FIG. 12, the cover 130 is further secured in the closed position C by ultrasonic welding of the attachment end 158. The ultrasonic welding melts and deforms the attachment end 158, forming the attachment end 158 as a staked head 160. In another embodiment, the attachment end 158 can be heat staked into the staked head 160. The staked head 160 extends beyond the slot 126 and engages the exterior surface 120 of the main body 110 to fix the cover 130 in the closed position C. In an embodiment, the cover 130 is only secured to the main body 110 by forming the attachment end 158 into the staked head 160.

Figure 13:
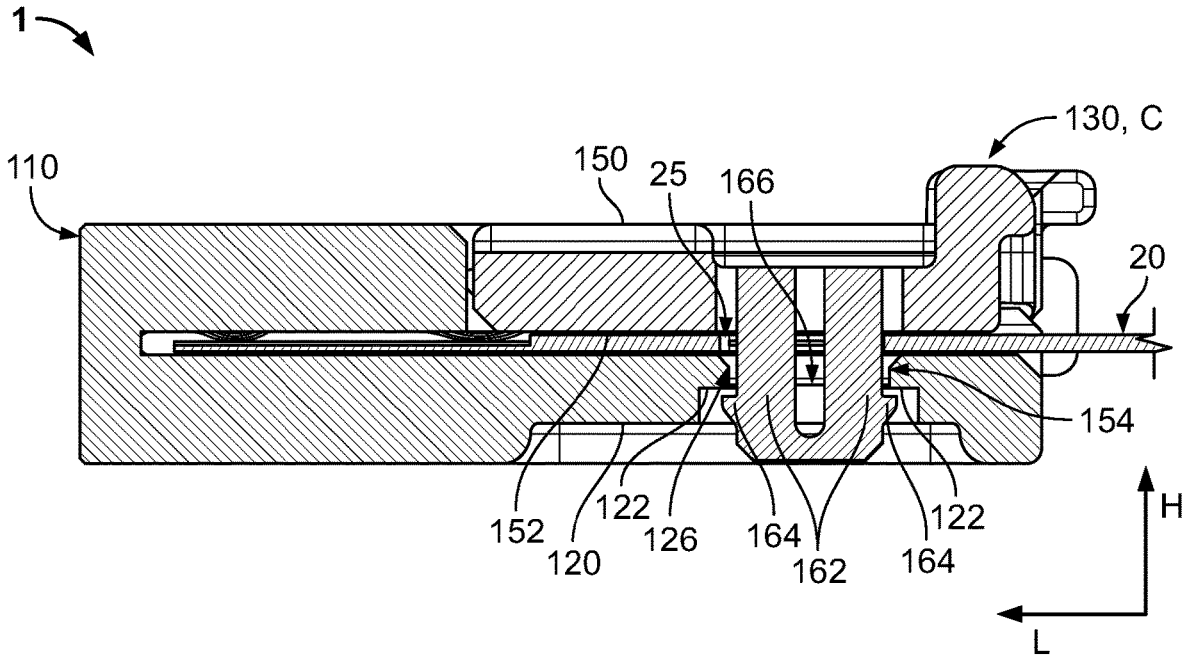
FIG. 13 is a sectional side view of a connector assembly according to another embodiment in a closed position.
Figure 14:
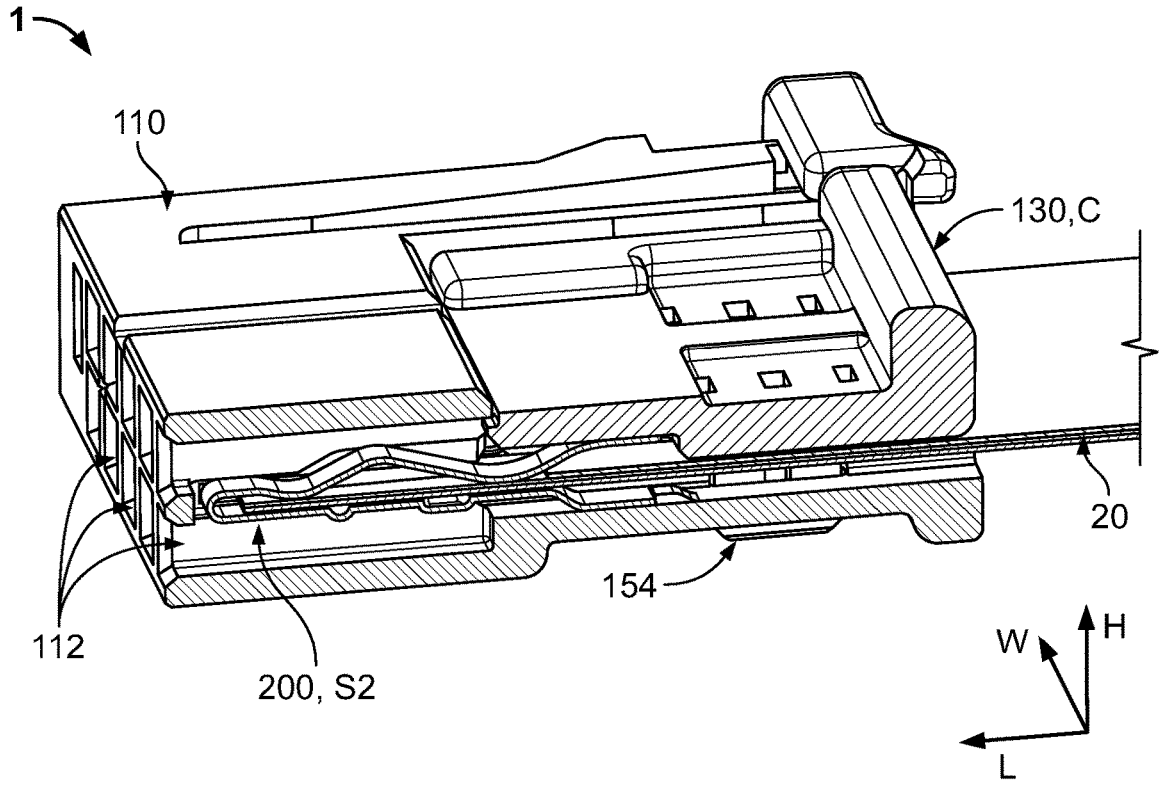
FIG. 14 is a sectional perspective view of the connector assembly of FIG. 13 in the closed position.

A connector assembly 1 according to another embodiment is shown in FIGS. 13 and 14. Like reference numbers indicate like elements and primarily the differences with respect to the connector assembly 1 shown in FIGS. 6-12 will be described herein.

The peg 154 of the cover 130, in the embodiment shown in FIG. 13, has a pair of resilient arms 162 extending beyond the interior surface 152 along the height direction H. Each of the resilient arms 162 has a catch 164 extending beyond a side of the resilient arm 162. The peg 154 has an opening 166 disposed between the resilient arms 162, which are connected to each other at an end distal from the interior surface 152. The resilient arms 162 are resiliently deflectable toward the opening 166 and toward each other.

In the embodiment of FIGS. 13 and 14, when the cover 130 is inserted into the closed position C, the resilient arms 162 are deflected toward each other as the catches 164 pass through the peg openings 25 and the slots 126. When the catches 164 pass the exterior surface 120 of the main body 110, the resilient arms 162 elastically restore from the deflected state to the position shown in FIG. 13. The catches 164 each engage a seat 122 of the main body 110 on the exterior surface 120 to secure the cover 130 in the closed position C on the main body 110. As shown in FIG. 14, the closed position C of the cover 130 holds the spring clip 200 in the second state S2.

Figure 15:
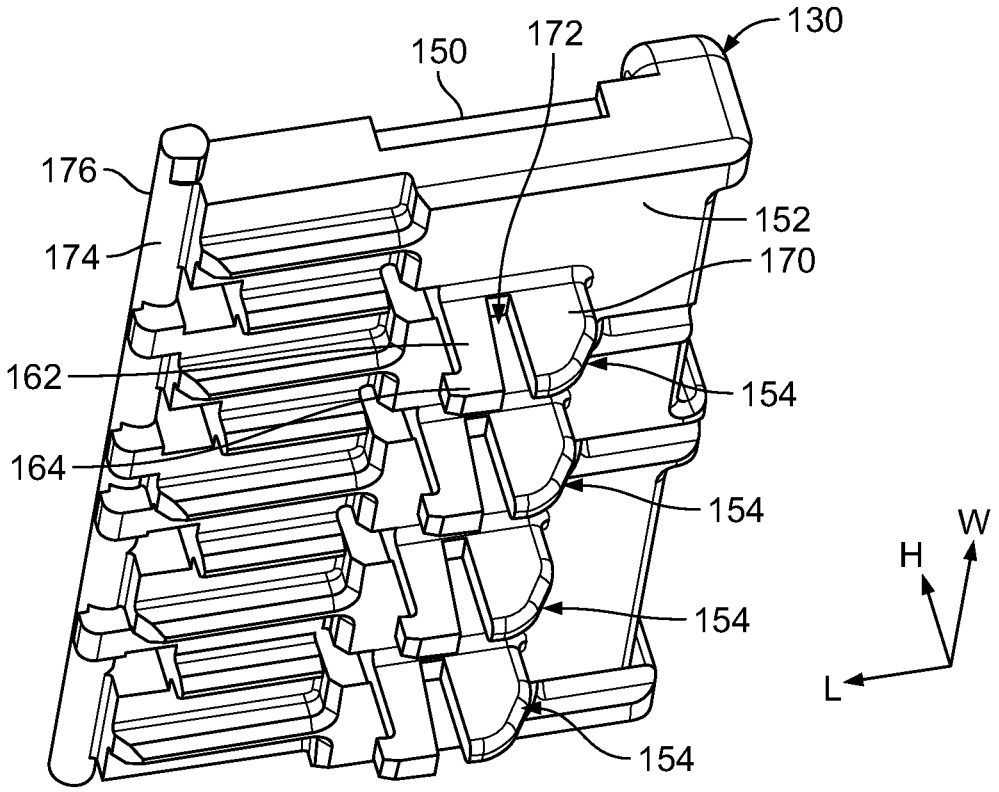
FIG. 15 is a perspective view of a cover of a connector assembly according to another embodiment.
Figure 16:
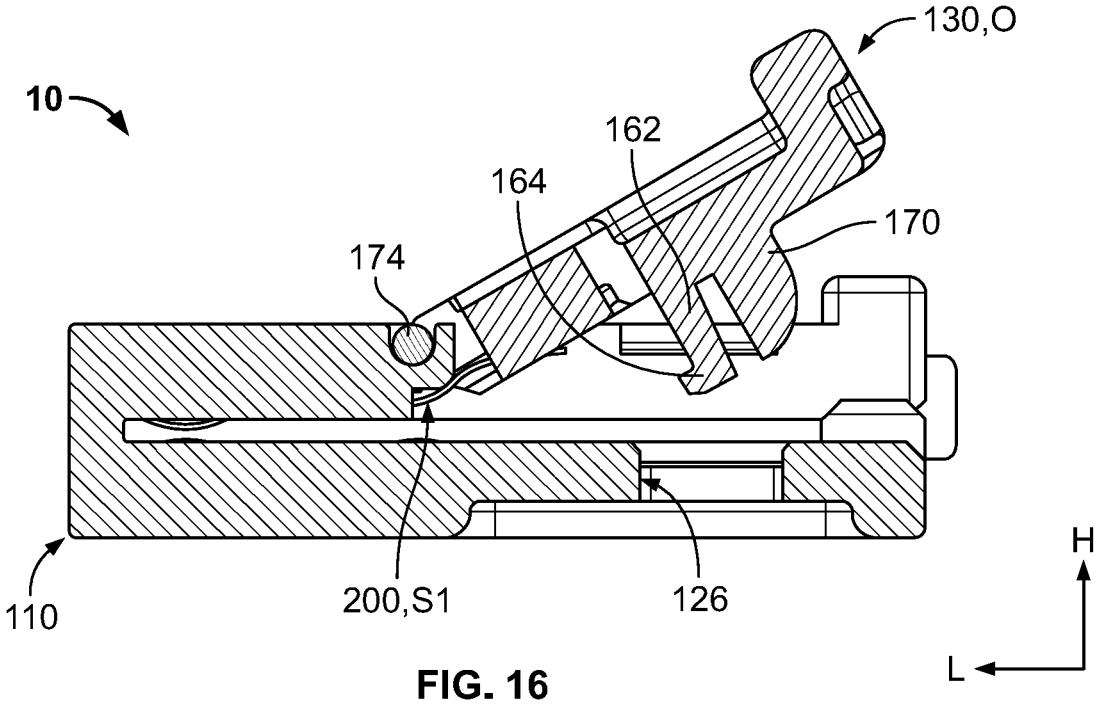
FIG. 16 is a sectional side view of a connector of the connector assembly of FIG. 15 in an open position.
Figure 17:
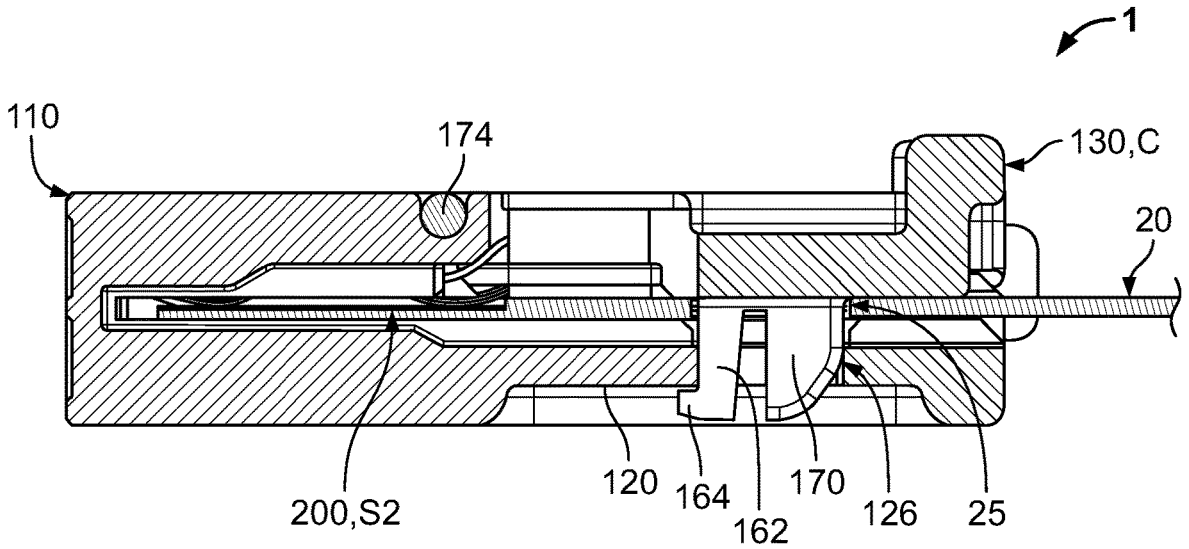
FIG. 17 is a sectional side view of the connector assembly of FIG. 15 in a closed position.

A connector assembly 1 according to another embodiment is shown in FIGS. 15-17. Like reference numbers indicate like elements and primarily the differences with respect to the connector assembly 1 shown in FIGS. 13 and 14 will be described herein.

Each of the pegs 154 of the cover 130, as shown in the embodiment of FIG. 15, has a resilient arm 162 and a curved arm 170 extending adjacent to one another from the interior surface 152. The resilient arm 162 has a catch 164 at a free end and is resiliently deflectable toward the curved arm 170 and into an opening 172 between the resilient arm 162 and the curved arm 170. The curved arm 170 has a fixed position with respect to the cover 130. The cover 130 has a hinge 174 at the front surface 176.

As shown in FIGS. 16 and 17, the cover 130 is attached to the main housing 110 at the hinge 174 and is rotatable with respect to the main housing 110 between the open position O and the closed position C. In the shown embodiment, the hinge 174 is part of the cover 130 and is separate from the main housing 110. In another embodiment, the cover 130 can be monolithically formed with the main housing 110 and the hinge 174 can be a flexible part of the monolithic piece, for example, a plastic hinge.

In an embodiment, the cover 130 can be releasably held in the open position O shown in FIG. 16 while the FFC 20 is inserted into the connector 10. From the open position O, the cover 130 is pivoted about the hinge 174. The catch 164 abuts the main body 110 at the slot 126 and deflects the resilient arm 162 toward the curved arm 170 as the cover 130 is pivoted toward the closed position C. When the catch 164 reaches the exterior surface 120, the resilient arm 162 elastically restores into the closed position C shown in FIG. 17 in which the catch 164 engages the exterior surface 120 and secures the cover 130 in the closed position C on the main body 110. As shown in FIG. 17, the closed position C of the cover 130 holds the spring clip 200 in the second state S2.

Figure 18:
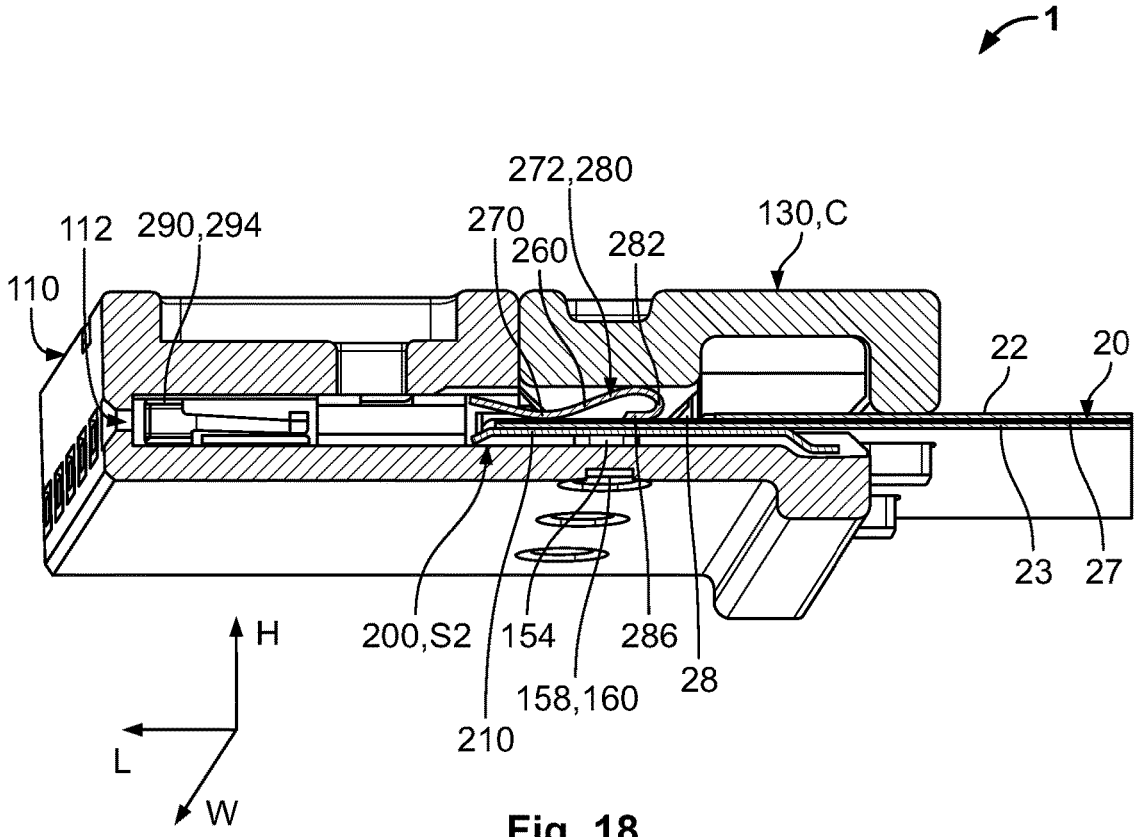
FIG. 18 is a sectional perspective view of a connector assembly according to another embodiment in a closed position.

A connector assembly 1 according to another embodiment is shown in FIG. 18. Like reference numbers indicate like elements and primarily the differences with respect to the connector assembly 1 according to the above embodiments will be described herein. The connector assembly 1 shown in FIG. 18 includes a spring clip 200 according to another embodiment.

The spring clip 200, as shown in FIG. 18, has a pin interface 294 as the connection section 290. In the shown embodiment, the pin interface 294 is a box and spring interface adapted to resiliently abut and electrically connect to a contact pin. In other embodiments, the pin interface 294 may be any type of interface adapted to electrically connect to a contact pin that is connected to the first beam 210 and the second beam 260 and permits resilient deflection of the second beam 260 toward the first beam 210.

In the embodiment shown in FIG. 18, the second contact portion 272 is a friction lock 280 instead of the second contact bend 274. The friction lock 280 includes a bent portion 282 of the second beam 260 bent back toward the connection section 290 and the first beam 210. The bent portion 282 ends in an edge 286 extending in the width direction W. The bent portion 282 can be bent back toward the connection section 290, in various embodiments, at an angle between 90 degrees and 180 degrees, or at any other angle that allows the engagement of the friction lock 280 with the conductor 27 as described below.

In the closed position C of the cover 130 shown in FIG. 18, and in the second state S2 of the spring clip 200, the cover 130 compresses the friction lock 280 into engagement with the conductor 27. The bent portion 282 is held in a position in the second state S2 in which the edge 286 and/or a curved section of the bent portion 282 adjacent to the edge 286 mechanically and electrically engages the conductor 27 on the first side 28 of the conductor 27. In an embodiment in which the edge 286 engages the first side 28 of the conductor 27, the edge 286 bites into the first side 28 but does not fully cut through the conductor 27. If the FFC 20 is moved or pulled in the longitudinal direction L, the bent portion 282 resists the movement as it resists rotating out of the bent state shown in FIG. 18; the harder the FFC 20 is pulled, the stronger the engagement of the edge 286 and/or the curved section of the bent portion 282 with the conductor 27 and the stronger the resistance to movement of the FFC 20.

The spring clip 200 of FIG. 18 is shown with an embodiment of the cover 130 having the attachment end 158 formed into the staked head 160 in the closed position C, as shown in the embodiment of FIG. 12. The spring clip 200 with the friction lock 180, however, can be used with any of the embodiments of the cover 130 described herein with the bent portion 282 compressed and the edge 286 engaging the conductor 27 in the closed position C. The friction lock 280 is shown as part of an embodiment including the pin interface 294 as the connection section 290 but could alternatively be used in the same manner with the connection section 290 as the curved portion 292 in the other embodiments described herein. The pin interface 294 likewise could also be used with any of the embodiments of the spring clip 200 described herein including, for example, the second contact portion 272 embodied as the second contact bend 274.

What is claimed is:

1. A connector for a flat flexible cable, comprising:

a housing including a main body having a closed section and an open section, and a cover, the cover is movable with respect to the main body between an open position and a closed position; and a spring clip disposed in the housing, the spring clip including a first beam and a second beam connected to the first beam, the second beam has a free end and is resiliently deflectable toward the first beam by the cover, the spring clip is in a first state with the cover in the open position in which the spring clip abuts a conductor exposed through an insulation material of the flat flexible cable with a first contact force and the free end being positioned in the open section of the main body and exposed to an exterior of the main body, the spring clip is in a second state with the cover in the closed position in which the spring clip abuts the conductor with a second contact force greater than the first contact force.

2. The connector of claim 1, wherein the cover has a beam receiving passageway with an upper surface and a pair of side surfaces, each of the side surfaces has a ramp protrusion extending into the beam receiving passageway.

3. The connector of claim 2, wherein the upper surface has an upper flat section and an upper sloped section, and the ramp protrusion has a ramp flat section and a ramp sloped section.

4. The connector of claim 3, wherein the second beam has an end positioned between the upper flat section and the ramp flat section in the first state.

5. The connector of claim 4, wherein the second beam is resiliently deflected toward the first beam and into the second state by abutment of the end of the second beam with the upper sloped section.

6. The connector of claim 1, wherein the cover abuts the free end of the second beam in the closed position and moves the spring clip to the second state.

7. The connector of claim 6, wherein the cover has a peg extending from an interior surface of the cover to an attachment end of the peg, the attachment end extends through a slot of the open section of the housing in the closed position.

8. The connector of claim 7, wherein the attachment end is formed into a staked head to fix the cover in the closed position.

9. The connector of claim 7, wherein the peg includes a resilient arm with a catch engaging the housing in the closed position.

10. The connector of claim 9, wherein the peg includes a pair of resilient arms deflectable toward each other, each of the resilient arms has the catch.

11. The connector of claim 9, wherein the peg includes a curved arm, the resilient arm is deflectable toward the curved arm.

12. The connector of claim 11, wherein the cover is connected to the housing by a hinge and is pivotable about the hinge between the open position and the closed position.

13. The connector of claim 1, wherein the second beam has a first contact bend extending toward the first beam, the first contact bend abuts the conductor with the first contact force in the first state and the second contact force in the second state.

14. The connector of claim 13, wherein the first beam and the second beam are connected at a connection section, the second beam has a second contact portion positioned further from the connection section than the first contact bend, the second contact portion abuts the conductor in the second state.

15. The connector of claim 14, wherein the second contact portion is a second contact bend extending toward the first beam or a friction lock including a bent portion of the second beam bent back toward the connection section and the first beam.

16. A connector assembly, comprising:

a flat flexible cable having:

an insulation material;

a post opening extending through the insulation material; and a plurality of conductors embedded in the insulation material, the plurality of conductors are exposed through a portion of the insulation material; and a connector including a housing and a spring clip disposed in the housing, the housing includes a main body and a cover movable with respect to the main body between an open position and a closed position, the flat flexible cable is positioned in the spring clip, the spring clip is in a first state with the cover in the open position in which the spring clip abuts the conductor of the flat flexible cable with a first contact force, the spring clip is in a second state with the cover in the closed position in which the spring clip abuts the conductor with a second contact force greater than the first contact force, the main body having a post extending through the post opening in the open position and the closed position.

17. The connector of claim 16, wherein the flat flexible cable has a peg opening extending through the insulation material, the cover has a peg extending through a slot of the housing and the peg opening in the closed position.

18. A connector for a flat flexible cable, comprising:

a housing including a main body, and a cover movable with respect to the main body between an open position and a closed position in which the flat flexible cable is captured between the main body and the cover, the cover including a peg extending in an insertion direction through a slot of the housing in the closed position, in the closed position the peg defining at least one surface opposing the housing in a direction opposite the insertion direction for securing the cover in the closed position; and a spring clip disposed in the housing, the spring clip is resiliently deflectable by the cover, the spring clip is in a first state with the cover in the open position in which the spring clip abuts a conductor exposed through an insulation material of the flat flexible cable with a first contact force, the spring clip is in a second state with the cover in the closed position in which the spring clip abuts the conductor with a second contact force greater than the first contact force.

19. The connector of claim 18, wherein an end of the peg defines a latch for engaging with the housing in the closed position of the cover and opposing the housing in the direction opposite the insertion direction of the peg.

20. The connector of claim 18, wherein, in the closed position of the cover, the peg defines a staked end having a cross-section having at least one dimension that is greater than a corresponding dimension of the slot for securing the cover in the closed position.

* * * * *